US005501169A

United States Patent [19]

Denker

[11] Patent Number: 5,501,169

[45] Date of Patent: Mar. 26, 1996

[54] UNIVERSAL CANOE ACCESSORY MOUNTING BRACKET

[76] Inventor: James M. Denker, 711 First Parish Rd., Scituate, Mass. 02066

[21] Appl. No.: 452,327

[22] Filed: May 26, 1995

[51] Int. Cl.[6] ..... B63B 43/14

[52] U.S. Cl. ..... 114/364; 114/347; 114/123; 114/344

[58] Field of Search ..... 114/364, 123, 114/343, 344, 347, 61, 352; 405/1

[56] References Cited

U.S. PATENT DOCUMENTS

| | | | |
|---|---|---|---|
| 4,579,357 | 4/1986 | Webster | 114/344 |
| 4,807,551 | 2/1989 | Ace | 114/347 |
| 4,862,818 | 9/1989 | Sullivan | 114/364 |

*Primary Examiner*—Edwin L. Swinehart

*Attorney, Agent, or Firm*—Hale and Dorr

[57] ABSTRACT

A multi-purpose bracket which clamps across both gunwales of a canoe and presents a standardized pad at each side of the hull to align precisely and mount rigidly a variety of accessories. These accessories include multi-hull catamaran coupling bars, portaging wheels, and any other equipment requiring a temporary but strong and secure means of attachment. The very large forces and moment loadings generated by such accessory equipment are borne directly by the bracket's strong tubular beam and then transmitted safely to the hull by distributing them through both gunwales as simple direct tension and compression forces. The standardized mounting pads provide a common basis for future development of many accessory devices that can enhance both the utility and enjoyment of canoes, while enabling such equipment to be shared and used interchangeably by any canoe equipped with a bracket according to the invention.

11 Claims, 4 Drawing Sheets

FIG. 3
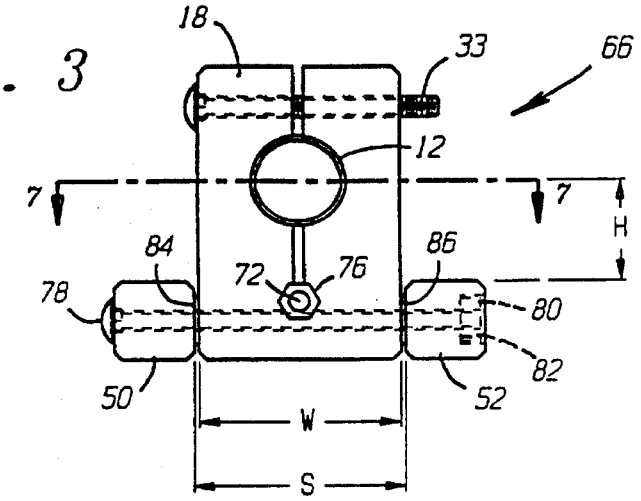
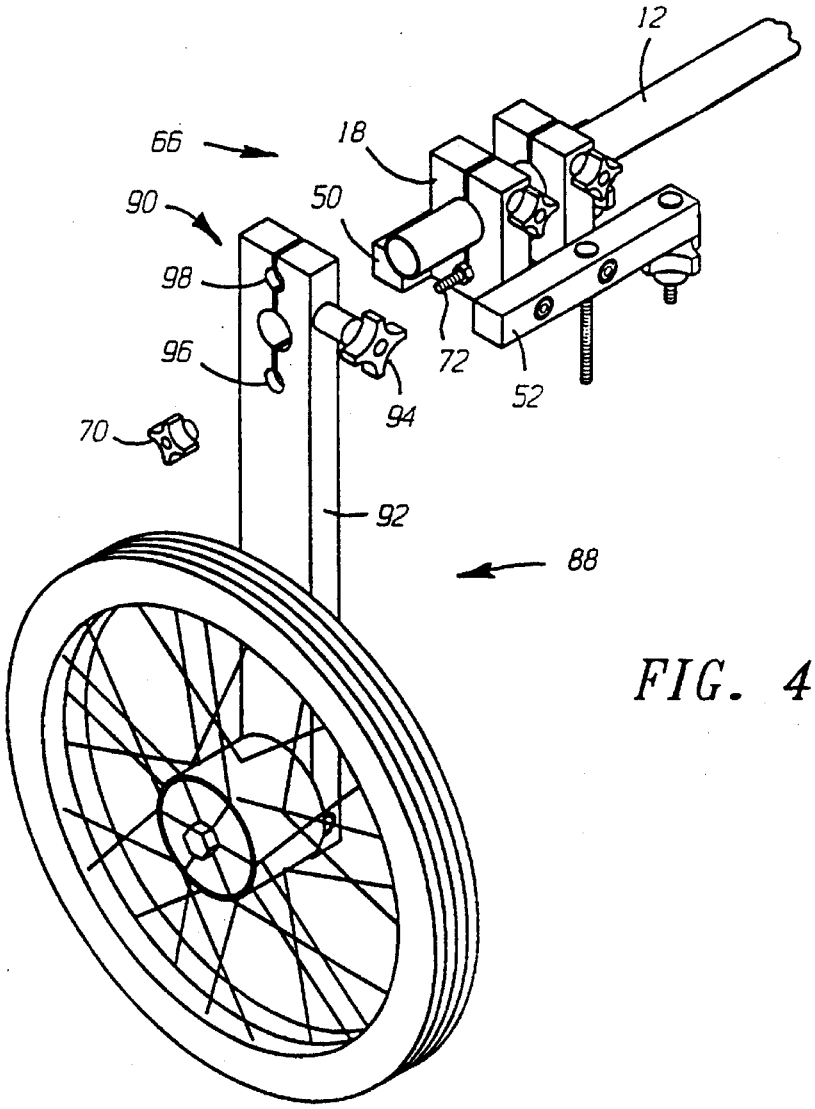
FIG. 4

UNIVERSAL CANOE ACCESSORY MOUNTING BRACKET

This invention relates to canoes and, more particularly, to a mounting bracket for permitting a wide range of accessories to be mounted on a canoe.

BACKGROUND OF THE INVENTION

Canoes are manufactured in many configurations, each representing an optimization for some intended purpose or purposes in an expected operating environment. Some factors which influence canoe design are: cost, weight, load carrying capacity, directional and roll stability, maneuverability in fast water, freeboard, paddling ease, use with motor or sail power, and maintenance needs.

Other service requirements, and the need to have any given canoe serve more than its primary intended purpose, have spawned an accessory market. Generally, these accessories are either designed for universal application and perform poorly, such as strap-on wheeled carts which shift in use, or are designed for specific applications and work well, but cannot be shared among several different canoes. In addition, accessories designed for specific applications often require hull modification for proper attachment, such as reinforcement of mounting areas or drilling of holes. Examples of this would be sail rigs where the mast is stepped to the bottom inner surface of the hull and stabilizing floats or sponsons bolted to the hull above the water line.

Canoes in a group sortie or owned by a multi-canoe family, a canoe-rental business, or a camp will quite often be of several different designs. This makes it difficult or impossible to share the use of some desirable accessories and limits group use to a few general purpose accessory products. Thus, there is an evident need to develop a universal canoe accessory mounting bracket which can be easily and securely coupled to almost any popular canoe and which permits the quick interchange of a whole range of accessories that are optimized to take advantage of the common bracket, rather than compromised to fit various canoes.

OBJECTS OF THE INVENTION

The main object of this invention is to provide a universal canoe accessory mounting bracket fitting most canoes and having standardized dimensions to accept a variety of interchangeable accessories such as portaging wheels or catamaran coupling bars, for example. Analogous is the well known three-point hitch used as a universal means to adapt a variety of farm implements to any tractor. The present invention establishes a standard basis for future development of accessories not feasible without it.

Another object is to provide a standardized canoe accessory mounting bracket which attaches quickly and easily without any modification of the canoe, and which is able to withstand maximum working loads without any slippage or marring of the canoe.

Yet another object of this invention is to provide a canoe accessory mounting system that positively locates interchangeable accessories so each can be quickly and accurately coupled in a repeatable position without requiring the use of any tools.

A further object of this invention is to provide a universal canoe accessory mounting bracket that is lightweight, low cost, rugged, and whose appearance complements the beauty of any canoe.

BRIEF DESCRIPTION OF THE INVENTION

The invention employs a rigid, tubular beam spanning across both gunwales to establish a precise alignment reference and to carry all combined force and moment loadings from accessories through to both gunwales. The beam is attached at each gunwale by a pair of integral parallel-jaw clamps, spaced apart (fore and aft) so that twisting loads generated by accessories result in simple tension and compression forces acting on both gunwales. Each pair of clamps is held to the beam by two split blocks which can slide on the beam to suit the gunwale spacing. With all four clamp jaws engaging the gunwales, the four split blocks grip the beam and the clamp jaws are tightened firmly under the gunwales.

When so fixed in place, the invention presents a mounting pad on each side of the boat comprising a vertical flat surface with a round tubular beam, a threaded steel stud, and two square locating blocks protruding horizontally. These elements may be used individually or in combinations, as appropriate for each accessory and the load conditions it will encounter. While it is beyond the scope of the present invention to describe in detail all of the accessories it will accept, they will most certainly include portaging wheels, outriggers, leeboards, a mast and sail, hydrofoils, coupling bars, and alternate propulsion systems.

The present invention in no way limits the variety or form of the many possible accessory devices that may be developed as the need for them is recognized. Rather, the invention provides a convenient interface which should foster the rapid development of many more accessories than would be practical without it.

In a preferred embodiment, the tubular beam is galvanized steel, with its inside diameter plastic coated so accessories can easily slide in and out of the beam without scuffing and the outside diameter will remain rust free for clamping. All other parts are made from white ash wood for strength, light weight, and beautiful appearance in keeping with the finish of many popular canoes. Ash wood jaws also have the advantage of being virtually non-marring to the gunwales on which they are clamped.

In another preferred embodiment, the dimensions are chosen so that the two locating blocks are spaced just a little more than 2.50 inches apart and placed a little more than 1.25 inches below the centerline of the tube. This allows them to accurately locate any 2.50 inch width member (a wheel strut, for example) in either a horizontal or vertical position, when it is mounted on the tube with its centerline at the central axis of the tube.

BRIEF DESCRIPTION OF THE FIGURES OF THE DRAWING

FIG. 3 is an elevation view showing just the port side mounting pad portion of the universal canoe accessory mounting bracket, with most other parts omitted for clarity.

FIG. 4 is an exploded isometric view (taken from the same vantage point as FIGS. 1 and 2) of the port side mounting pad of the universal canoe accessory mounting bracket with a typical wheel and strut assembly shown aligned and ready for mounting in its normal working position on the pad.

DETAILED DESCRIPTION OF THE PREFERRED EMBODIMENTS OF THE INVENTION

Figure 1:
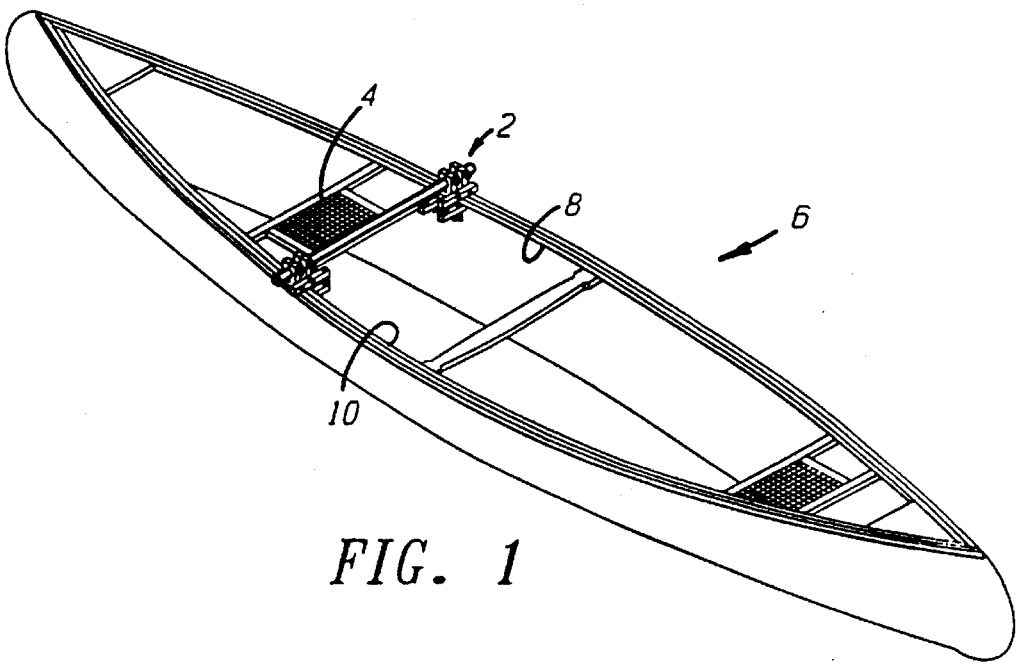
FIG. 1 is an isometric view of the universal canoe accessory mounting bracket installed in its normal position on the gunwales of a typical canoe, just aft of the front seat.

In a preferred embodiment of the claimed invention, as shown in FIG. 1, a universal canoe accessory mounting bracket 2 is shown mounted in normal working position a few inches behind the front seat 4 of a typical canoe 6. It should be here noted that this bracket assembly may be placed anywhere along the gunwales 8 and 10 if required by some particular accessory device, although the location shown (just aft of the forward seat) is ordinarily chosen because it does not cause any interference with paddling or normal use of the canoe.

Figure 2:
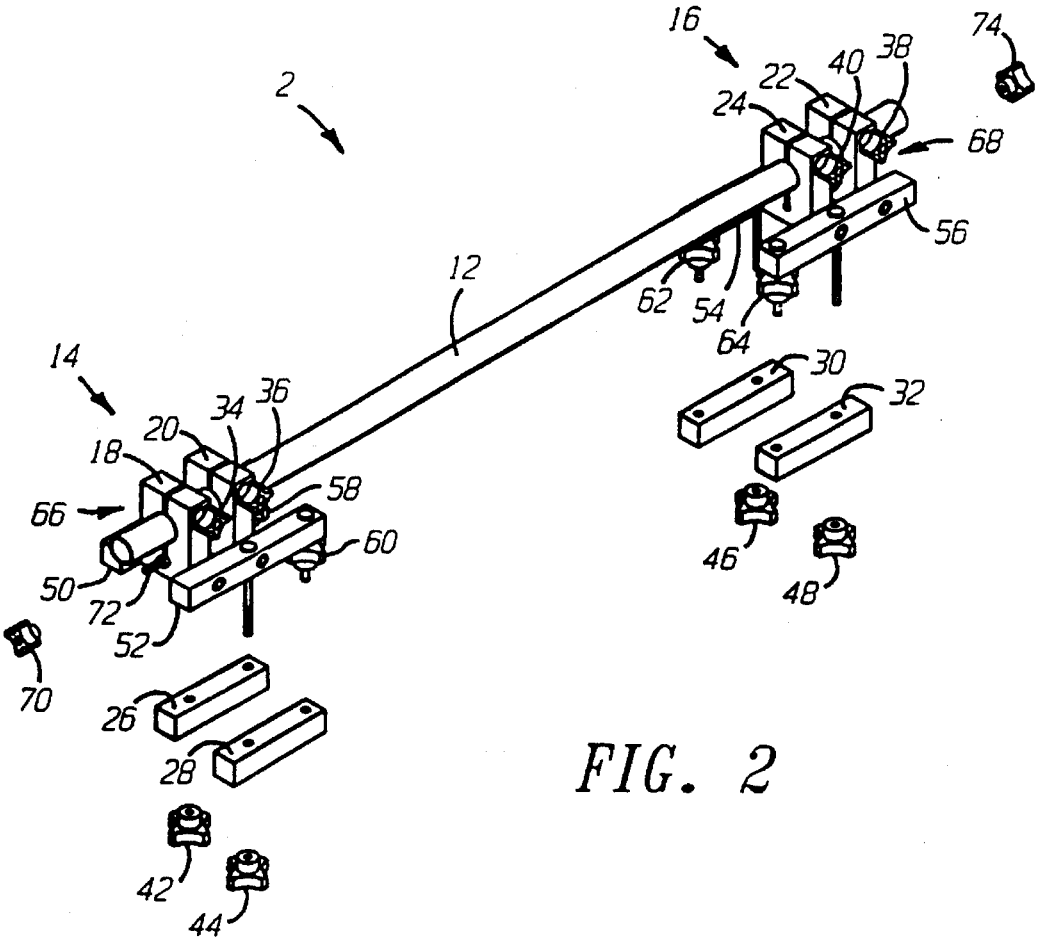
FIG. 2 is a larger partially exploded isometric view (taken from the same vantage point as FIG. 1) of a complete universal canoe mounting bracket alone.

Referring now to FIG. 2, a complete bracket assembly 2 is shown partially exploded to better reveal the several elements of its construction. A strong and rigid tubular beam 12 about 40 inches long engages and aligns the port and starboard gunwale clamp assemblies 14 and 16 respectively. Pinch blocks 18, 20 and 22, 24 are positioned upon beam 12. Port clamp blocks 50, 52 are attached to the sides of the pinch blocks 18, 20 on the port side of canoe 6 with their lower edges substantially flush with the bottom of the pinch blocks. As shown most clearly in FIGS. 2, 4, and 7, each clamp block projects outwardly 1 inch beyond the outer face of pinch block 18 and about 3 inches inwardly beyond the inner face of pinch block 20. The undersides of port clamp blocks 50, 52 engage the upper side of the port gunwale 10. Port clamp jaws 26, 28 are attached by carriage bolts to port clamp blocks 50, 52 in position below and generally aligned with a respective one of the clamp blocks. The upper sides of clamp jaws 26, 28 engage the underside of gunwale 10. At the starboard side of canoe 6 substantially identical starboard clamp blocks 54, 56 are attached to pinch blocks 22, 24 with their lower sides engaging the upper side of gunwale 8, and starboard clamp jaws 30, 32 are attached to the clamp blocks 54, 56 with the upper sides of clamp jaws 30, 32 engaging the underside of gunwale 8.

Approximately equal lengths of tubular beam 12 protrude outwardly about 2.3 inches beyond the outer faces of the respective outer pinch blocks 18 and 22. A saw kerf in each of the pinch blocks 18, 20, 22, and 24 allows each to be closed and locked solidly to beam 12 by carriage bolts and clamp knobs 34, 36, 38, and 40 respectively.

Clamp jaws 26, 28, 30, and 32 are tightened by clamp knobs 42, 44, 46, and 48 respectively, threaded onto carriage bolts passing through and permanently locked by hex nuts into clamp blocks 50, 52, 54, and 56 respectively. The jaw reaction forces are borne by threaded knobs 58, 60, 62, and 64 between clamp jaws 26, 28, 30, 32 and clamp blocks 50, 52, 54, 56 respectively. The clamp jaws 26, 28, 30, and 32 are all identical and proportioned so that the reaction forces on knobs 58, 60, 62, and 64 are only one-third of the clamping forces developed on the gunwales. This 3:1 mechanical leverage makes it easy to achieve very high clamp jaw forces with only gentle finger pressure on knobs 58, 60, 62, and 64 rather than the very high effort required to turn knobs 44, 46, and 48 at the same jaw forces.

As shown in FIG. 2, the clamp jaws and clamp blocks are predrilled for the connecting carriage bolts. As is evident from FIG. 1, and shown also in FIG. 7, the gunwales 8, 10 of the canoe 6 are converging in the region where the universal canoe accessory mounting bracket is usually attached. Accordingly, and as shown most clearly in FIG. 7, the forward clamp block at each pair of pinch blocks, e.g., clamp blocks 50 and 54, is slightly longer than the adjacent aft clamp block, and projects slightly farther inwardly towards the centerline of the canoe. To provide for mounting at different points along the length of the canoe, and to accommodate unusual canoe tapers, it may in some circumstances be desirable to provide slotted, or more than one pair of holes, in the clamp jaws 26, 30 associated with clamp blocks 50, 52.

From the foregoing, it should be understood pinch blocks 20, clamp blocks 50, 52 and the projecting open end of tubular beam 12 constitute a port mounting pad 66, and that a similar starboard mounting pad 68 is provided by pinch blocks 22, clamp blocks 54, 56 and the other projecting open end of tubular beam 12. Because of symmetry, when the universal canoe accessory mounting bracket 2 is positioned and tightened in place, it self-aligns to produce true horizontal and vertical reference surfaces in the mounting pads 66 and 68 defined by the outer faces of the pinch blocks 18, 22, the upper faces and the inner (i.e. facing the adjacent block) faces of the clamp blocks 50, 52, 54, 56, and the projecting open ends of tubular beam 12 at the port and starboard sides respectively of canoe 6. Each mounting pad further includes a stud 72 which projects outwardly from the respective pinch block faces slightly below the upper faces of the clamp blocks and midway between them. Knob 70 is threaded onto a stud 72 in pad 66 for use as required in attaching certain accessories. Knob 74 is threaded onto the similar stud (not shown) in pad 68 for the same purpose.

FIG. 3, which is taken looking directly at the port side of the bracket 2, shows the face of pinch block 18, the outer ends of clamp blocks 50 and 52, threaded stud 72 (actually a ¼–20 by 2 inch length carriage bolt passing through pinch block 18 from the far face) locked in place by hex nut 76, and the open port end of tubular beam 12. Pinch block 18 is closed down and locked solidly to tubular beam 12 by carriage bolt 33 and knob 34 (not shown in this view, but seen in FIG. 2), so the face of pinch block 18 is held exactly perpendicular to the longitudinal axis of tubular beam 12. Clamp blocks 50 and 52 are attached to pinch block 18 by carriage bolt 78 and hex nut 80, recessed just below flush in counterbore 82 in the side of clamp block 52.

The three blocks are spaced slightly apart by 1/16 inch thickness flat washers 84 and 86, so that the space S between clamp blocks 50 and 52 is approximately ⅛ inch greater than the width W of pinch block 18. This is to allow sufficient clearance for easy insertion of an accessory having the same width W as the pinch block 18 between the two clamp blocks 50 and 52, yet still serve as a relatively accurate location reference for the accessory.

Similarly, the height H of the centerline of tubular beam 12 above the top surfaces of clamp blocks 50 and 52 is such that H is slightly greater than one-half the width W, and preferably equals exactly one-half the spacing distance S. This allows an accessory of width W to be slipped over the tubular beam 12 and located either between the clamp blocks 50 and 52 or completely above them. Since the tubular beam 12 is also located on the vertical centerline of pinch block 18, symmetry produces four distinct and repeatable positions in which an accessory can be mounted.

It should be here noted that threaded stud 72 is located on the centerline of pinch block 18 and is also between the clamp blocks 50 and 52, where it does not interfere with an accessory mounted in either of the two horizontal positions. For the two vertical positions, however, the accessory must be provided with a proper clearance hole (or holes) to pass over threaded stud 72. When in a vertical position, an accessory may be both clamped on tubular beam 12 and clamped against mounting pad 66 by tightening knob 70 on threaded stud 72, resulting in great rigidity. In the horizontal position, an accessory may be mounted only by clamping on the outside diameter of tubular beam 12. Thus, it is possible to choose the position and the clamping configuration to suit the function and required load capacity of each type of accessory.

To illustrate this point, FIG. 4 shows an isometric view of a port side mounting pad 66, with a typical wheel and strut assembly 88 aligned with mounting pad 66 in the vertical/down position in which it would normally be used to transport a canoe over rough ground. The high forces and moments produced require a very rigid mounting to withstand the loads and still maintain accurate alignment with the other wheel assembly.

In the vertical/down position, the bored and saw-cut top end 90 of wheel strut 92 slides over the end of tubular beam 12 and threaded stud 72, and is positively located between clamp blocks 50 and 52. Knob 70 engages stud 72 and clamps strut 92 firmly against the face of pinch block 18. The large threaded knob 94 operating on a carriage bolt (not shown) draws the kerfed end of strut 92 together, locking it firmly on the outside diameter of tubular beam 12. The joint is now able to prevent all relative movement due to direct force loading, bending moments, and twisting torques about the axis of the tubular beam 12. Two clearance holes 96 and 98 are provided in strut 92 so it may also be installed in the vertical/up position, with the same high load capacity for transporting the canoe in an upside-down attitude. This mounting position of the two wheel and strut assemblies also enables the canoe to serve as a very convenient camping shelter.

Figure 5:
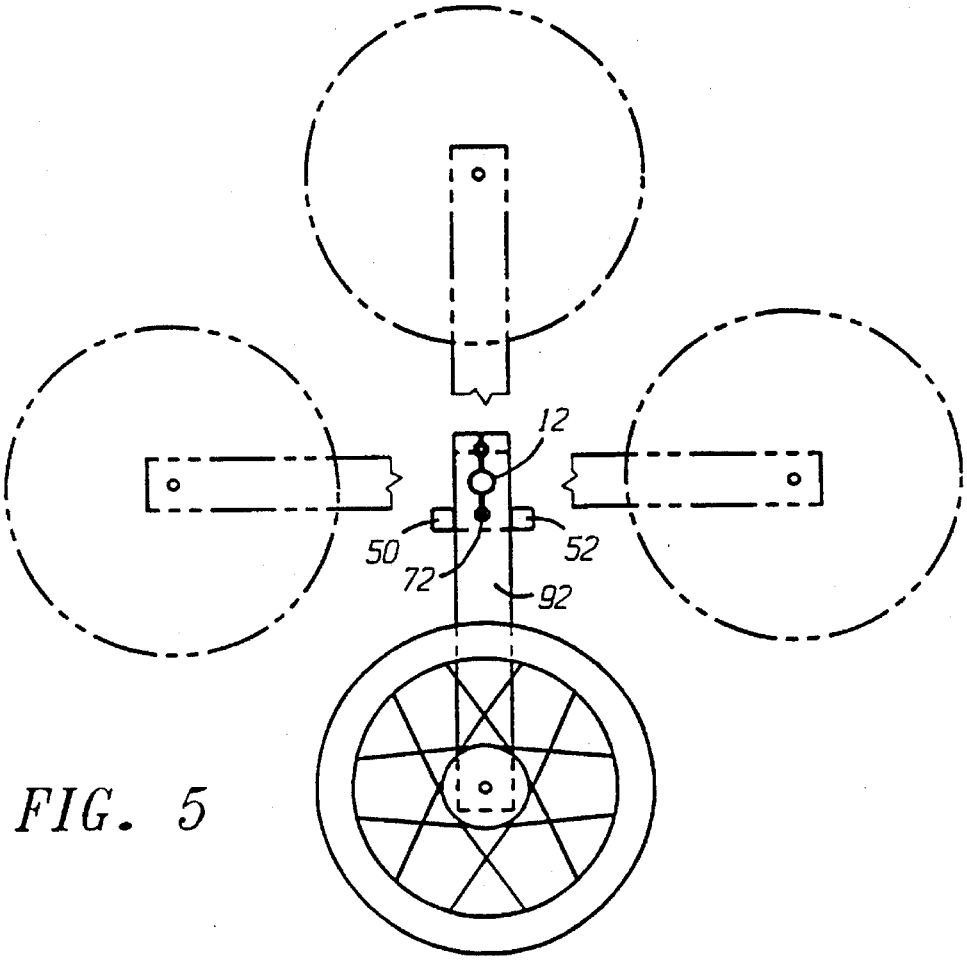
FIG. 5 is a port (left) side elevation view of the port side mounting pad of the universal canoe accessory mounting bracket showing the four positions in which a typical wheel and strut assembly may be indexed and mounted on the pad.

When not in use, wheel assembly 88 may be slid out of engagement with clamp blocks 50, 52 and threaded stud 72, rotated 90 degrees about the tubular beam 12, and then stowed in the horizontal position. The wheel strut 92 will be located by clamp blocks 50, 52 and may be clamped on the tubular beam 12, but it does not (and does not need to) engage the threaded stud 72. The four possible mounting positions are illustrated by FIG. 5, in which wheel strut 92 is drawn in the vertical/down position for normal transporting use. The other three positions are shown in phantom, indicating how the strut 92 can be rotated about the centerline of tubular beam 12 when disengaged from the clamp blocks 50, 52 and threaded stud 72.

Figure 6:
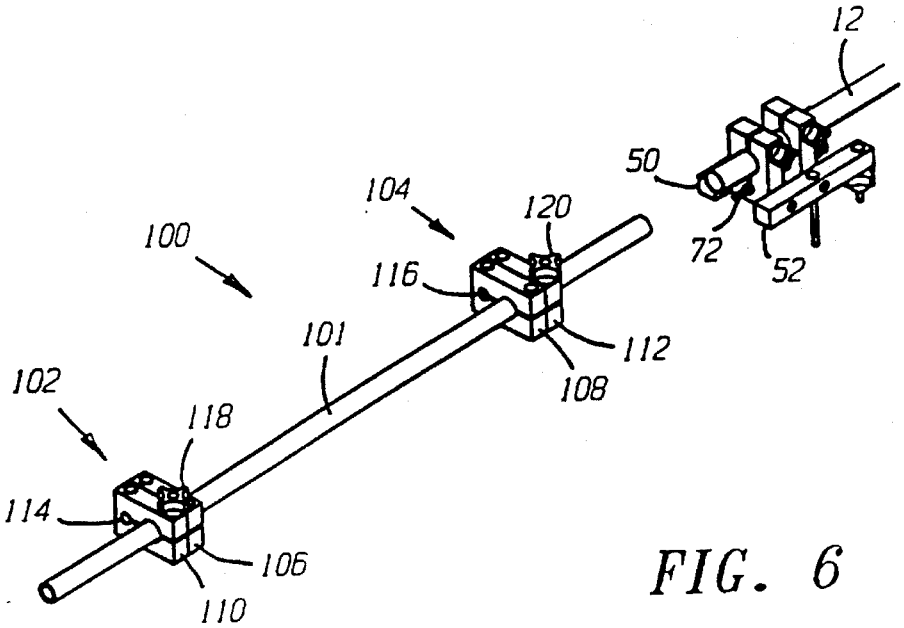
FIG. 6 is an exploded isometric view (taken from the same vantage point as FIGS. 1, 2, and 4) of the port (left) side mounting pad of the universal canoe accessory mounting bracket with a typical coupling bar assembly shown aligned and ready for insertion inside the tubular beam and clamping on the outside diameter of the protruding end of the tubular beam.
Figure 7:
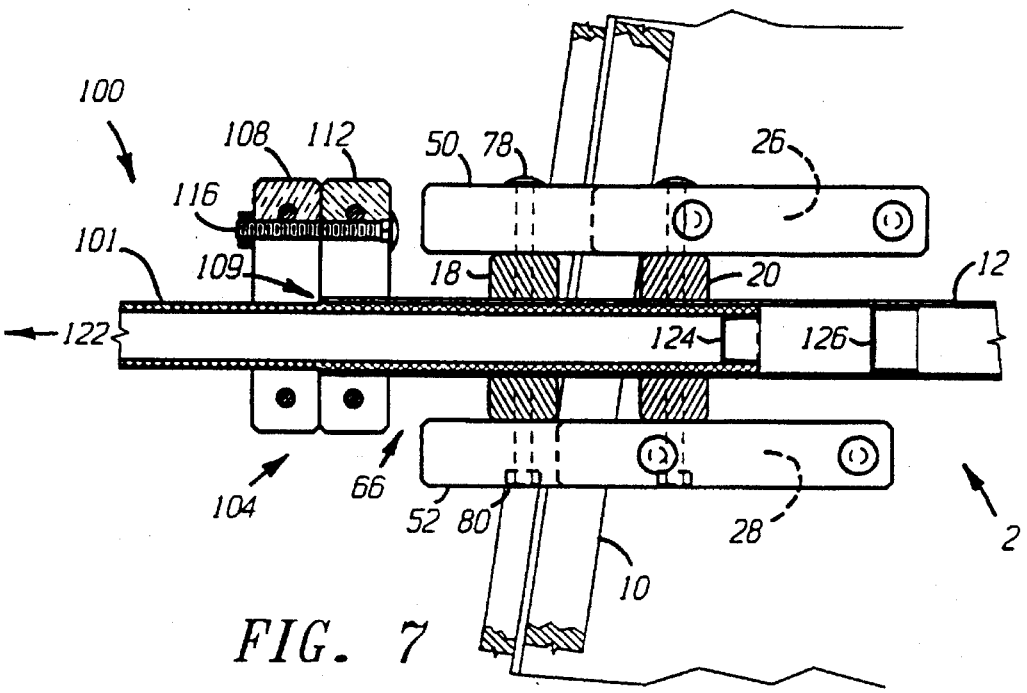
FIG. 7 is a partial sectional top view (taken at the centerline of the tubular beam, as indicated on FIG. 3) of the port (left) side of the universal canoe accessory mounting bracket with a typical coupling bar assembly shown fully inserted into and clamped onto the end of the tubular beam, and showing the clamp blocks, pinch blocks, and mounting pad in their typical locations in relation to the port (left) side gunwale of a typical canoe hull.
Figure 8:
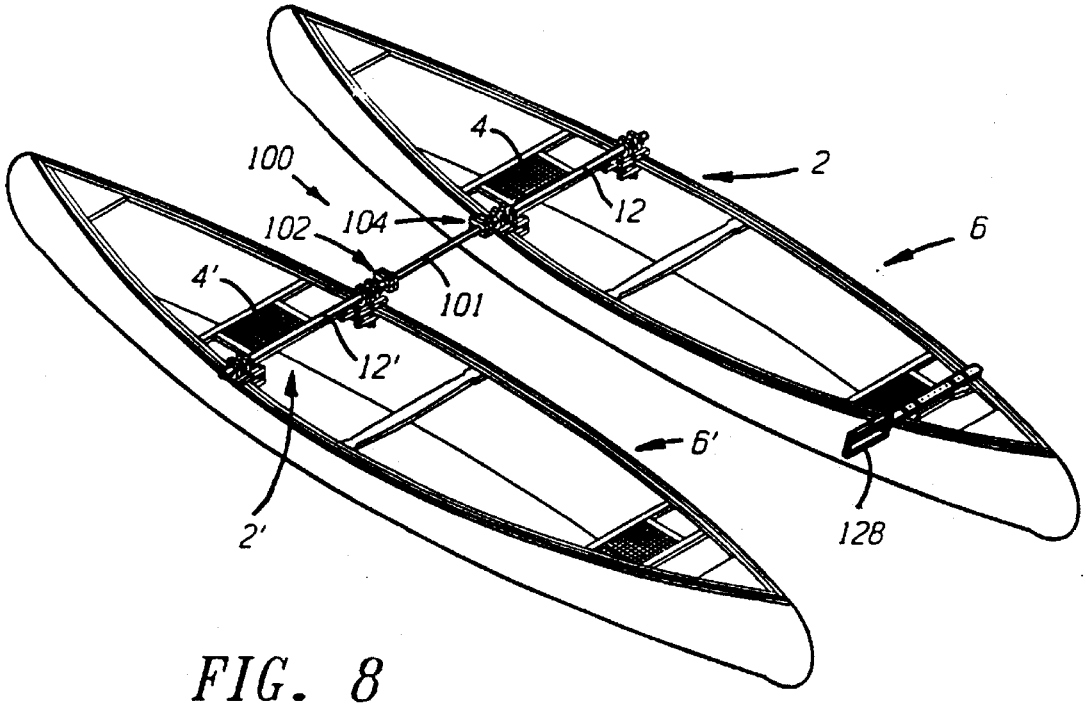
FIG. 8 is an isometric view (taken from the same vantage point as FIGS. 1, 2, 4, and 6) of 2 typical canoes, each fitted with a universal canoe accessory mounting bracket and coupled together in the catamaran configuration by a typical coupling bar assembly.

Reference is now made to FIGS. 6–8, which illustrate the manner in which the bracket of the present invention may be used to connect a pair of canoes together, side-by-side. FIG. 6 is an isometric view of mounting pad 66, with an accessory coupling bar assembly 100 aligned with tubular beam 12 and ready for insertion into the open end of tubular beam 12. When two canoes are being connected together, it is not necessary or even desirable to transmit torsion loads between them. Thus, the coupling bar assembly 100 includes a pair of clamping collar assemblies, designated 102, 104, but neither assembly includes clamp blocks or threaded studs similar to clamp blocks 50, 52, 54, 56 or threaded stud 72. Similarly, and as will be apparent hereinafter, coupling bar assembly 100 is connected to bracket 2 in such a way that it does not engage the clamp blocks or stud of mounting pad 66. When coupling bar assembly 100 is used to join two canoes side-by-side, the coupling bar 101 will generate bending moments in both the vertical and horizontal planes through the slidable joint of bar 101 and tubular beam 12. To transmit axial loads, a pair of clamping collar assemblies 102 and 104 are attached to bar 101 to prevent sliding movement of the bar 101 within tubular beam 12' of universal canoe accessory mounting bracket assembly 2' (not shown here, but shown in FIG. 8) and within the tubular beam 12 of the universal canoe accessory mounting bracket assembly 2 respectively. In the interest of brevity, only the attachment of clamping collar assembly 104 to universal canoe accessory mounting bracket assembly 2 (as shown in FIG. 7) will be described in detail.

As shown, clamping collar assemblies 102 and 104 each comprise a first collar 106 and 108 respectively, immovably fixed to coupling bar 101, and a second collar 110 and 112 respectively, loosely held to the first collar by a single permanent bolt 14 and 116 respectively. Coupling bar 101 has an outer diameter slightly less than the inner diameter of tubular beam 12 so that the bar will fit freely into the beam with a relatively snug slip fit. Collars 110, 12 have inside diameters which are larger than bar 101, and are only slightly greater than the outer diameter of tubular beam 12, so that the collars are able to slide easily over the end of tubular beam 12. Collars 110, 112 are saw kerfed so they can be easily closed-down onto beam 12 by carriage bolts (not shown) and hand clamping knobs 118 and 120, respectively.

When, as shown in FIG. 7, the end of coupling bar 101 is slipped into tubular beam 12, collar 108 provides a positive stop position 109 for the end of beam 12, with collar 112 fully surrounding and engaged with beam 12, assuring a secure grip when hand knob 120 is tightened. Bolt 116 prevents separation of the two collars due to axial tension forces, but offers virtually no resistance to the small twisting motions caused by relative pitching movements of two joined canoes.

FIG. 8 illustrates the proportions of a combination of typical 16-foot hulls coupled at a separation distance of about 2 feet, from which the minimal effects of pitching motions should be evident. It should be understood that the same description applies to the apparatus of both canoes, and would also apply to as many canoes as might be coupled together at one time in similar fashion (as when having a floating raft-picnic, for example).

Referring back now to FIG. 7, it should be noted that the design of the universal canoe accessory mounting bracket provides a very close match to the tapered hull shape of any ordinary canoe. Clamp blocks 50 and 52 are of unequal length in order to provide about ½ inch of offset between the positions of clamp jaws 26 and 28, so that both can fully engage the underside of gunwale 10. It should also be noted that the mounting pad 66, comprising the outer surface of pinch block 18 together with the protruding clamp blocks 50 and 52, is located near but outboard of the gunwale 10. This is to provide clearance for accessories to be mounted against pad 66 without interference from the hull.

In FIG. 7 we also see coupling bar 101 shown as tubular, rather than solid. The strength and flexibility characteristics of standard 1 inch outside diameter pultruded fiberglass tubing are nicely matched to the requirements of joining two canoes in the manner described above. This offers the benefit of net positive buoyancy if both ends of coupling bar 101 are sealed by plastic plugs 122 (not shown) and 124, so coupling bar assembly 100 will not sink if accidentally dropped in the water. Similarly, plastic plug 126 and another one just like it in the other end of tubular beam 12 can seal the space inside tubular beam 12 for a small gain in floatation in the event the canoe should for any reason become swamped. However, any or all these plastic plugs may be removed easily should some future accessory require a clear passageway through the universal canoe accessory mounting bracket 2 or the coupling bar assembly 100.

Finally, from FIG. 8 we can clearly see a major practical advantage in using the universal canoe accessory mounting bracket to join canoes in a catamaran configuration: both canoes 6 and 6' can still be paddled on both sides by both front and rear occupants, as if the canoes were not joined at all. Furthermore, the twin hulls offer greater directional stability, which makes paddling easier and more efficient. If alternative power is desired, any suitable small outboard engine or electric trolling motor may be mounted on a suitable commercial bracket 128 near the stern of the starboard canoe. This places the thrust between the two hulls, resulting in near-perfectly balanced hydrodynamic forces on the two hulls as they move through the water.

As will be evident to one of ordinary skill in manufacturing or design engineering, many possible variations in materials or design details could alter the appearance and the manufacturing costs of the apparatus disclosed herein without any real changes to its function. The foregoing description should be taken as illustrative and not limiting in any way.

Other embodiments of the invention are not described, but will be within the purview of the following claims.

What is claimed is:

1. An accessory mounting bracket assembly for mounting on the gunwales of a canoe, said bracket comprising:

a. a tubular beam of a length sufficient to span transversely across both gunwales of the canoe and project outwardly from the opposite outer sides of the gunwales;

b. a pair of gunwale clamp assemblies slidably mounted on said beam, each of said gunwale clamp assemblies having (i) a clamp removable but rigidly clamped on said tubular beam, (ii) a pair of clamp blocks spaced fore and aft with respect to each other with one block of each pair being positioned on each side of the tubular beam and with each of said blocks being arranged to engage the top surface of one of said gunwales, and a clamp jaw associated with each of said clamp blocks and arranged to engage the lower surface of one of said gunwales at a point below that at which the associated clamp block engages the top of the respective gunwale; and, c. a mounting pad defined by each of said clamp assemblies, each of said mounting pads including (i) the portion of said tubular beam projecting outwardly beyond said clamp of said clamp assembly, a first mounting surface positioned generally perpendicular to the axis of said tubular beam and defined by an outer surface of one of said clamps, and a second mounting surface positioned in a plane generally parallel to the axis of said tubular beam.

2. The assembly of claim 1 wherein said first surface of each of said clamp assemblies is defined by the outer surface of a said clamp of the said clamp assembly, and wherein each of said clamp assemblies includes a plurality of said second surfaces defined by portions of the said clamp blocks of the said clamp assembly that project outwardly beyond said first surface thereof.

3. The assembly of claim 1 wherein one of the said second surfaces of each of said clamp assemblies is perpendicular to a second of the said second surfaces thereof.

4. The assembly of claim 1 wherein each of said clamp assemblies includes a pair of said clamps axially spaced relative to each other and removably but rigidly attached to said tubular beam, each of said clamp blocks and clamp jaws extends generally parallel to said beam, and each of said clamp jaws is attached to a portion of a respective one of said clamp blocks located inward of the gunwale to which said clamp assembly is attached.

5. The assembly of claim 1 wherein each of said mounting pads includes means for holding a mating accessory device firmly against at least one of said first surface and said second surface thereof.

6. The apparatus of claim 5 wherein the said holding means in each said mounting pad is a threaded stud, located on the centerline of each said mounting pad between the two said clamp blocks, and extending outward from and perpendicular to the outboard face of each said mounting pad.

7. The apparatus of claim 1 wherein the two said clamp blocks of each of said clamping assemblies are separated by a distance d, and wherein the distance from the centerline of said tubular beam to the top of said two said clamp blocks is about, and not less than, ½ d.

8. The assembly of claim 1 wherein said tubular beam is generally circular in cross-section and includes a generally cylindrical inner bore, in combination with an accessory coupling bar comprising:

a. a cylindrical coupling bar having an outside diameter that is a slip fit inside the said inner bore of said tube;

b. at least one clamping collar assembly concentrically mounted upon said coupling bar and capable of clamping firmly on the outside diameter of the said body tube when said coupling bar is inserted into said body tube, while allowing a small amount of relative rotation only between said coupling bar and said body tube.

9. The combination of claim 8 including a second clamping collar assembly concentrically mounted upon and rigidly clamped to said coupling bar adjacent an axially-facing side of said one clamping collar assembly, and a connector attaching said second clamping collar assembly to said first collar assembly such as to permit limited relative movement of said clamping collar assemblies.

10. The apparatus of claim 1, in combination with an accessory having a mount including a longitudinally-extending generally rectangular in transverse cross-section bar having (i) a bore extending transversely therethrough sized and adapted to receive and circumferentially engage said tubular beam, (ii) a first face arranged to engage said first surface, and (iii) a second face arranged to engage said second surface, said mount being attached to a said mounting pad of said mounting bracket assembly with said bore engaging said tubular beam of said mounting pad, and said first and second faces thereof engaging said first and second surfaces of said mounting pad.

11. The combination of claim 1 including a threaded fastener attached to said mounting pad intermediate said clamp blocks thereof and below said tubular beam thereof, and attached also to said mount.

* * * * *